United States Patent [19]

Spector

[11] Patent Number: 4,763,369

[45] **Date of Patent: * Aug. 16, 1988**

[54] TRANSFORMABLE PILLOW

[76] Inventor: Donald Spector, 380 Mountain Rd., Union City, N.J. 07087

[ * ] Notice: The portion of the term of this patent subsequent to Jun. 9, 2004 has been disclaimed.

[21] Appl. No.: 16,124

[22] Filed: Feb. 18, 1987

Related U.S. Application Data

[63] Continuation-in-part of Ser. No. 876,415, Jun. 20, 1986, Pat. No. 4,670,924.

[51] Int. Cl.[4] ..... A47C 20/02

[52] U.S. Cl. ..... 5/434; 5/441; 5/490; 446/72; 446/74; 446/369

[58] Field of Search ..... 5/434, 436, 441, 490, 5/496, 482; 446/71, 72, 74, 369

[56] References Cited

U.S. PATENT DOCUMENTS

| | | | |
|---|---|---|---|
| D. 258,406 | 3/1981 | Elbaum et al. | 5/434 X |
| 944,910 | 12/1909 | Reilley | 5/490 |
| 1,269,276 | 6/1918 | Harris | 5/434 X |
| 1,861,668 | 6/1932 | Tenney | 5/441 |
| 2,961,668 | 11/1960 | Hayes | 5/434 |
| 3,346,892 | 10/1967 | Du Priest | 5/434 X |
| 3,378,948 | 4/1968 | Gervaise | 5/434 X |
| 4,133,064 | 1/1979 | Petrusek | 5/441 |
| 4,442,558 | 4/1984 | Alexander | 5/482 X |

FOREIGN PATENT DOCUMENTS

| | | | |
|---|---|---|---|
| 2452899 | 5/1976 | Fed. Rep. of Germany | 5/434 |
| 1601773 | 10/1970 | France | 5/434 |

*Primary Examiner*—Henry E. Raduazo
*Attorney, Agent, or Firm*—Michael Ebert

[57] ABSTRACT

A dual-function pillow which in its normal mode serves as a comfortable bed rest or any other conventional purpose, and in its transformed mode functions as a plaything. The pillow is constituted by a soft and compressible inner bag and a removable outer case which covers the bag, the outer case having printed on its face a two-dimensional character in humanoid or animal-like form. Means such as drawstrings or elastic bands are provided to encircle the outer case and constrict the pillow along transverse lines displaced from opposite ends of the case. The placement of these lines is such relative to the character on the face of the pillow as to transform the two-dimensional character into a three-dimensional figure whose form is generally that of the character.

7 Claims, 2 Drawing Sheets

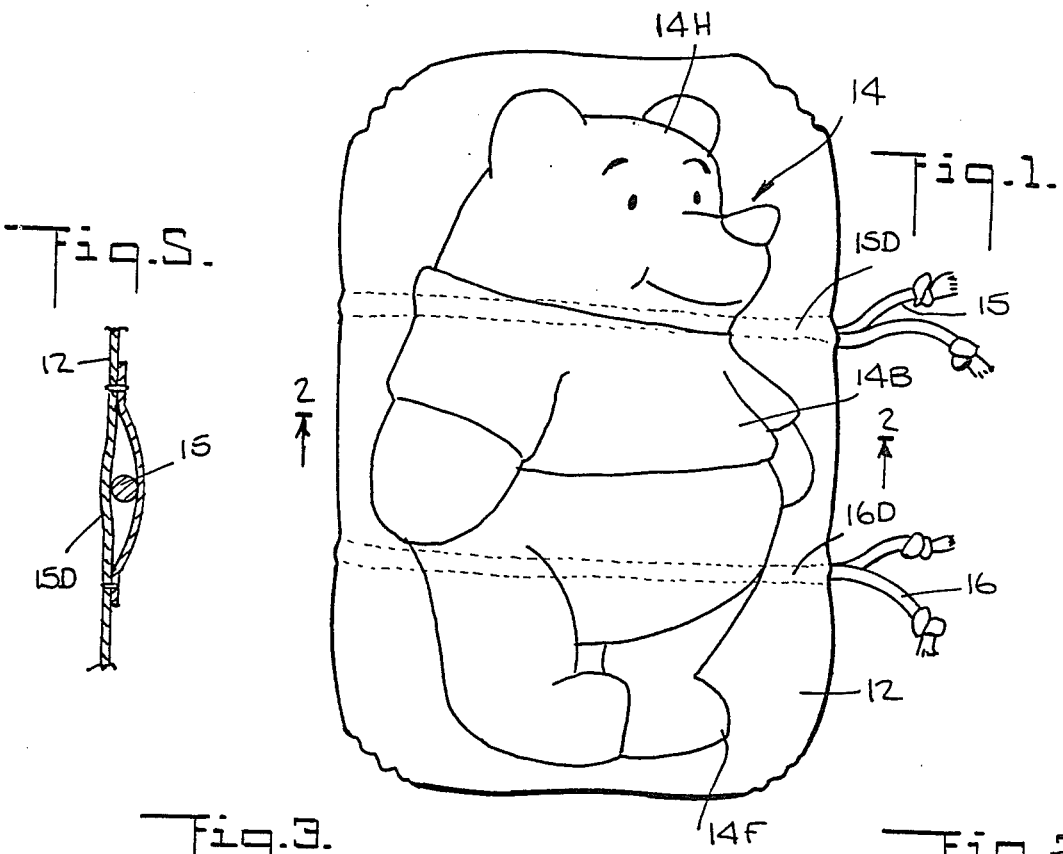
Fig. 1.
Fig. 5.
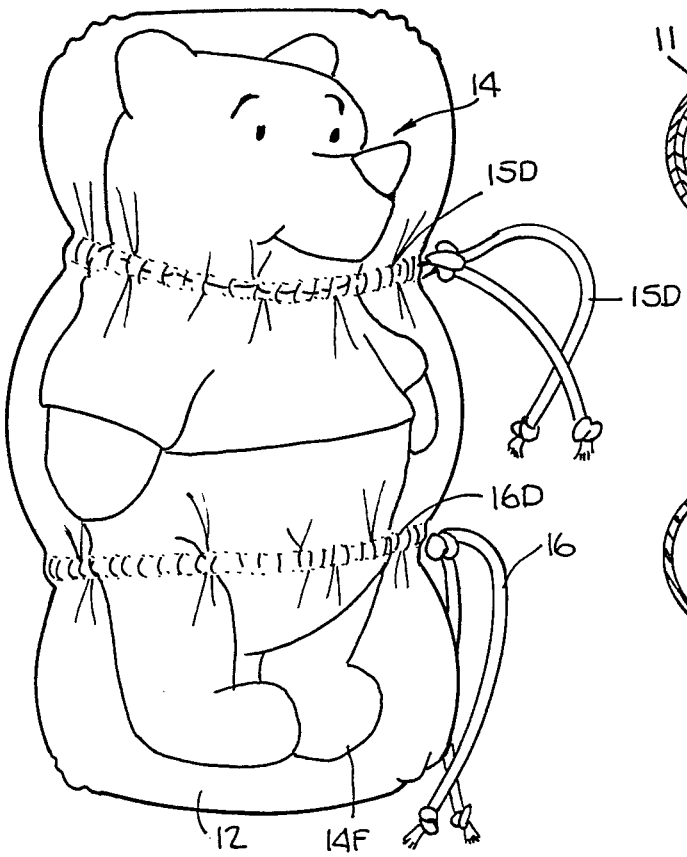
Fig. 3.
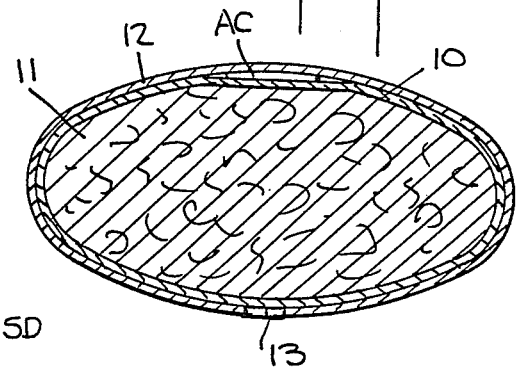
Fig. 2.
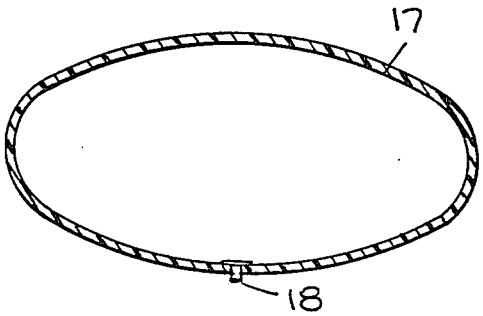
Fig. 4.

TRANSFORMABLE PILLOW

RELATED APPLICATION

This application is a continuation-in-part of my copending application of the same title, Ser. No. 876,415, filed June 20, 1986, now U.S. Pat. No. 4,670,924 whose entire disclosure is incorporated herein by reference.

BACKGROUND OF INVENTION

1. Field of Invention

This invention relates generally to slumber pillows, and in particular to a dual-function transformable pillow that in its normal mode functions as a comfortable head rest or for any other conventional purpose, and in its transformed mode assumes a figurative humanoid or animal-like form to serve as a plaything.

2. Status of Prior Art

A traditional pillow acts as a support for the head of a reclining individual or for any other conventional purpose and generally takes the form of a rectangular inner fabric bag filled with feathers, down, a foam-plastic pad or plastic fibers which produce a soft, compressible body. Pillows are also provided with a removable pillow case made of linen or cotton which protects the pillow bag from dirt. Hence when the pillow case is soiled, it can be removed and cleaned, the pillow bag itself remaining untouched.

In the case of children, a pillow also serves as a comforter; for when the head of a child rests on a pillow and is in intimate contact therewith, the soft pillow becomes warm and acts as a warm nest which imparts a sense of security to the child. Thus, in the mind of a child, a pillow ceases to be an inanimate object. Children also use pillows as playthings, and so-called pillow fights in which children hurl pillows at each other are commonplace.

To further personalize a pillow and to give it individuality, it is known to so shape or contour the pillow as to create a figurative form. Thus, design U.S. Pat. No. 258,406 to Elbaum et al. and the Hayes U.S. Pat. No. 2,961,688 show pillows in figurative forms. In the Hayes patent, the pillow includes simulated head and body portions as well as elongated arms that can be wrapped about the neck of the sleeping child so as to stimulate cuddling of the child by an older person.

The practical drawback of a contoured pillow which has a figurative form is that this form is not well suited to carry out the primary function of the pillow, which is that of a head rest. Best suited for this purpose is the conventional rectangular pillow.

Normally, the head of the reclining child rests on the center of the rectangular pillow, so that if in the course of sleep, should the head be shifted to either side of center, it will continue to be supported by a side portion of the pillow. But should the pillow itself be head shaped as in the Hayes patent, then the head of the child will roll off the pillow when the head shifts to one side in the course of sleep. Thus, by contouring of the pillow, one sacrifices to some degree its normal head rest characteristics.

Also of prior art interest are the patents to Harris, U.S. Pat. No. 269,276 and Reilley, U.S. Pat. No. 944,910, as well as the other references of record in the above-identified copending patent application.

SUMMARY OF INVENTION

In view of the foregoing, the main object of this invention is to provide a transformable dual-function pillow which in its normal slumber mode has the shape of a conventional pillow, and in its transformed mode has a figurative or three-dimensional character form.

A significant advantage of the invention is that the pillow in its normal slumber mode is fully as comfortable as a conventional pillow, whereas in its transformed mode, it is an attractive and appealing plaything.

Thus, when pillows in accordance with the invention in their transformed modes assume the form of characters now popular with children, such as animals or extraterrestrial characters, then children can identify with these characters and engage in pillow fights therewith rather than with nondescript conventional pillows, thereby enhancing the enjoyment of this play activity. And the pillows in their transformed mode may be used as stuffed dolls.

Alternatively, use may be made of stretchable elastic loops which encircle and constrict the pillow to effect the desired transformation thereof.

Briefly stated, these objects are attained in a dual-function pillow which in its normal mode serves as a comfortable bed rest or any other conventional purpose, and in its transformed mode functions as a plaything. The pillow is constituted by a soft and compressible inner bag and a removable outer case which covers the bag, the outer case having printed on its face a two-dimensional character in humanoid or animal-like form. Means such as drawstrings or elastic bands are provided to encircle the outer case and constrict the pillow along transverse lines displaced from opposite ends of the case. The placement of these lines is such relative to the character on the face of the pillow as to transform the two-dimensional character into a three-dimensional figure whose form is generally that of the character.

OUTLINE OF DRAWINGS

For a better understanding of the invention as well as other objects and further features thereof, reference is made to the following detailed description to be read in conjunction with the accompanying drawings, wherein:

FIG. 1 illustrates a first embodiment of a transformable pillow in accordance with the invention as seen from the front face thereof in its normal slumber mode;

FIG. 2 is a transverse section taken through the pillow in the plane indicated by line 2—2 in FIG. 1;

FIG. 3 shows the same pillow in its transformed mode;

FIG. 4 shows in transverse section a pneumatic pillow in accordance with the invention;

FIG. 5 is a section taken through the pillow to show one of the draw string ducts;

DESCRIPTION OF INVENTION

First Embodiment

Figure 6:
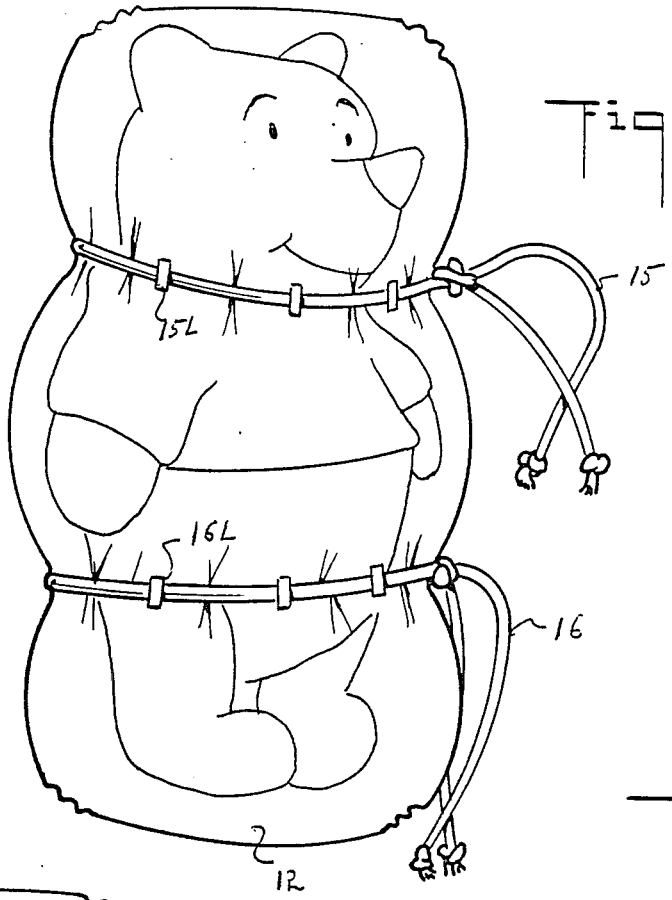
FIG. 6 illustrates a second embodiment of the pillow.

Referring now to FIGS. 1 and 2, there is shown a dual-function pillow in accordance with the invention, the pillow being formed by an inner bag 10 of generally rectangular form made of a suitable fabric, the bag being stuffed with a soft, compressible filler 11 which may be down or any other known filler material for this purpose.

The pillow is provided with a removable outer case 12 having the same form and preferably made of a plush-like material so as to stimulate the skin or fur of an animal such as a teddy bear. Case 12 is provided with a rear zipper 13 that extends most of its length, or other means such as a Velcro fastener placed along a rear slit, making it possible to insert the pillow bag in the case or to remove it therefrom so that the case can be cleaned.

Imprinted or otherwise applied to the top face of pillow case 12, as shown in FIG. 1, is a two-dimensional humanoid or animal-like FIG. 14. In the example shown, the figure is that of a well-known bear-like character having a head 14H, a body 14B and feet 14F. Case 12 is provided with two draw strings 15 and 16. String 15 passes through a transversely-positioned duct 15D formed in the case at about the junction between head 14H and body 14B, the duct extending through the front and rear of the case. String 16 passes through a transversely-positioned duct 16D formed in the case at about the junction between body 14B and feet 14F. Thus, the ducts 15D and 16D are positioned along transverse lines inwardly displaced from opposite ends of the pillow.

When draw string 15 is tightened and then knotted to hold it tight, this acts, as shown in FIG. 3, to constrict the junction between head 14H and body 14B; while when draw string 16 is similarly tightened and knotted, this acts to constrict the junction between body 14B and feet 14F. The resultant contouring of the pillow is such as to impart a three-dimensional form to the two-dimensional figure imprinted on the face of the pillow, so that in the transformed mode the pillow is no longer in a generally rectangular shape but is in a contoured shape suggestive of the animal or other character pictured thereon.

The invention is not limited to two draw strings, for the number of draw strings used and their positioning in the pillow case depends on the character to be formed in the transformed mode. Also, it is not necessary that the character be imprinted on the pillow case, for the case may be manufactured with a blank face which is of a material that lends itself to drawing thereon by crayon or water paint. Thus, the child who acquires the pillow can draw on its face a character that suits his fancy. Or what can be imprinted thereon is a cartoon or outline of a character which the child can then color as he wishes, so that the transformable pillow is convertible into a character created by the child and not the manufacturer.

Rather than use a removable pillow case, the pillow bag 10 can be imprinted on its face and provided with draw strings so that the pillow can be converted into a character. In this instance, the pillow bag is preferably made of an impermeable material such as fabric having a plastic facing skin laminated thereto which can be cleaned by a sponge.

And instead of using a conventional pillow having a filler therein, the pillow may be of the pneumatic type shown in FIG. 4, the pillow being formed by an inflatable bladder 17 having a valve 18.

To render the pillow more useful to a child, one may insert therein a settable electronic alarm clock, such as a miniature alarm clock with a digital readout and an audible alarm marketed by the Howard Miller Clock Company. This is in a flat credit card format and is called the "Alarm Card." This may be housed in a small soft fabric pouch and placed within the pillow so that when the alarm goes off, it can be heard only by the child sleeping on the pillow. Thus, as shown in FIG. 2, the flat alarm clock AC is placed between the pillow bag 10 and the pillow case 12. Also, the pillow may be provided with a battery-operated motorized mechanism adapted to tighten the draw strings at wakeup time to convert the pillow into a character and to later loosen the strings at a go-to-bed time and thereby again transform the character into a sleeping pillow. For this purpose, the draw string operating mechanism is operatively coupled to a settable electronic timer which can be set to any desired "wake-up" and "go-to-bed" time.

Other Embodiments

In the embodiment shown in FIG. 1, the drawstrings 15 and 16 which serve to constrict the pillow pass through ducts 15D and 16D formed in pillow case 12. A somewhat less expensive way of achieving the same result is shown in the embodiment of FIG. 6 wherein drawstrings 15 and 16 are maintained at their desired transverse positions by means of loops 15L and 16L sewed to the pillow case at spaced positions around its transverse perimeter so that the drawstrings encircle the pillow and, when drawn, act to convert the pillow into a three-dimensional figure.

In the FIG. 1 embodiment, the drawstrings are concealed within their respective ducts, whereas in FIG. 6 they are exposed. An advantage of these exposed drawstrings is that they can readily be withdrawn from their holding loops in the event one should wish to do away with the transformation feature.

Figure 8:
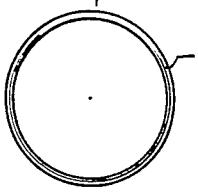
FIG. 8 shows an elastic loop usable with the third embodiment.
Figure 7:
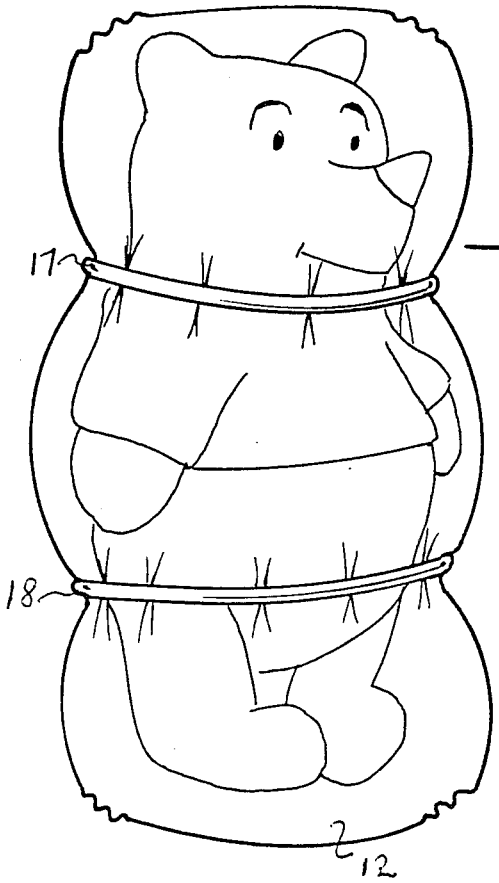
FIG. 7 illustrates a third embodiment.
Figure 9:
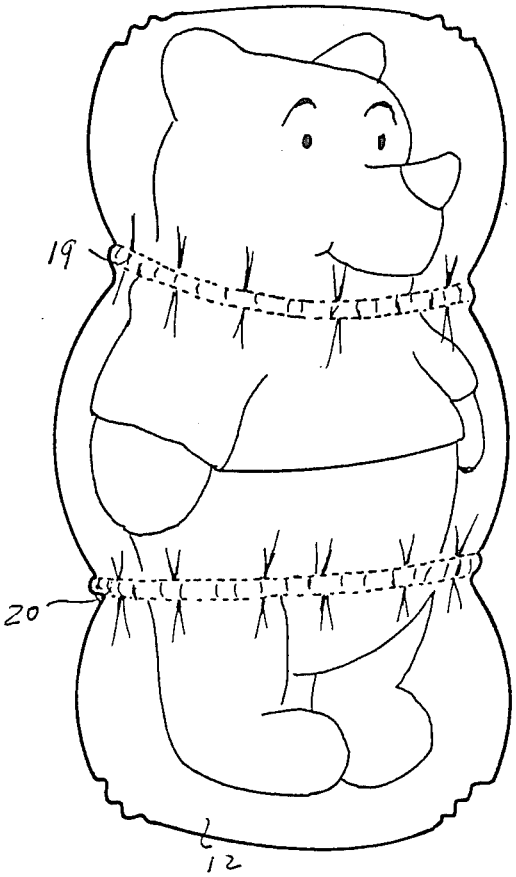
FIG. 9 illustrates a fourth embodiment.

In the embodiment shown in FIGS. 7 and 8, instead of drawstrings to constrict the pillow, use is made of circular elastic rings or bands 17 and 18. These are fabricated from an elastomeric fabric material whose color preferably matches that of the pillow case 12 so that the bands do not contrast with the pillow case and are therefore not conspicuous.

Instead of encircling the pillow case with drawstrings or elastic bands as in the previously described embodiments, one may obtain the desired constriction of the pillow by means of "Velcro" fabric tape fasteners. Such fasteners make use of a male tape component having myriad nylon hooks and a female component having myriad nylon loops, whereby when the male and female components are pressed together, they stick and cannot be disengaged except by peeling them apart.

In order to apply a Velcro fastener to the pillow case, the female tape component is sewed or otherwise attached to the pillow case at a site along the appropriate transverse line. The male tape component is attached to one end of a tail whose other end is secured to the transverse line at a position well displaced from the site of the female component. Hence by bringing the male component on the tail into engagement with the female component, in doing so one constricts the pillow, thereby transforming it to a three-dimensional figure. Hence to return the pillow to its normal mode, one releases the Velcro fasteners.

While there have been shown and described preferred embodiments of a transformable pillow in accordance with the invention, it will be appreciated that many changes and modifications may be made therein without, however, departing from the essential spirit thereof. Thus, in the fourth embodiment shown in FIG.

9, the pillow is constricted by elastic bands 19 and 20 which are sewn onto the rear surface of the case 12 and are therefore concealed. In this instance, the case is always constricted, and the inner bag must therefore be forced into the case, the elastic bands yielding to admit the inner bag.

Still another means for transforming the pillow into a three-dimensional character is to sew or otherwise attach tie strings to the pillow case, one pair for each transverse position, the strings being attached to opposite edges of the case. The user can then draw and tie each pair of tie strings either on the front or the rear of the pillow to effect the required constriction.

I claim:

1. A dual function pillow comprising:

(A) an inner bag having a compressible filler therein;

(B) a removable outer case for covering the bag, said case having a character drawn in two dimensions printed on its face; and (C) means engaging the outer case to constrict the pillow along transverse lines displaced from opposite ends of the case, the placement of the lines relative to the character being such as to contour the pillow to transform the two-dimensional character into a three-dimensional figure whose form is generally that of the character, the pillow being usable as a conventional head rest or for any other conventional purpose in its non-constricted state.

2. A dual-function pillow as set forth in claim 1, wherein said means are constituted by draw strings which pass through holding loops attached to the exterior of the case.

3. A dual function pillow as set forth in claim 1 in which said means are constituted by removable circular elastic bands which are stretchable to encircle said pillow.

4. A dual function pillow as set forth in claim 1 in which said means are constituted by circular elastic bands which are secured to the pillow case and act to constrict the pillow.

5. A dual-function pillow as set forth in claim 3, wherein said bands in their unstretched state have a circumference that is substantially smaller than the transverse perimeter of the pillow in its normal mode.

6. A dual-function pillow as set forth in claim 5, wherein said bands are formed of a fabric whose color is the same as that of the pillow case.

7. A dual-function pillow as set forth in claim 4, wherein said bands are secured to the interior face of the pillow case.

* * * * *